US005850945A

United States Patent [19]

Frankel

[11] Patent Number: 5,850,945

[45] Date of Patent: Dec. 22, 1998

[54] DISPENSER FOR SHAMPOO, LIQUID SOAP OR THE LIKE

[75] Inventor: Gail B. Frankel, Dallas, Tex.

[73] Assignee: Kel-Gar, Inc., Dallas, Tex.

[21] Appl. No.: 740,294

[22] Filed: Oct. 25, 1996

[51] Int. Cl.[6] ..... B65D 1/32

[52] U.S. Cl. ..... 222/212; 222/206; 222/78

[58] Field of Search ..... 222/78, 181.1, 222/181.3, 221, 215, 556, 534, 536

[56] References Cited

U.S. PATENT DOCUMENTS

| | | | |
|---|---|---|---|
| 611,653 | 10/1898 | Standiford . | |
| 1,660,085 | 2/1928 | Nassau . | |
| 2,272,465 | 2/1942 | Horstman | 221/102 |
| 2,739,420 | 3/1956 | Dugdale | 46/237 |
| 3,078,016 | 2/1963 | Judy | 222/181 |
| 3,105,612 | 10/1963 | Krasnoff et al. | 222/78 |
| 3,220,609 | 11/1965 | Russell et al. | 222/78 |
| 3,388,835 | 6/1968 | Naughten | 222/78 |
| 3,623,638 | 11/1971 | Henning et al. | 222/78 |
| 4,166,553 | 9/1979 | Fraterrigo | 222/181 |
| 4,470,523 | 9/1984 | Spector | 222/181 |
| 4,749,104 | 6/1988 | Chao | 222/78 |
| 4,793,517 | 12/1988 | Washut | 222/129 |

*Primary Examiner*—Andres Kashnikow
*Assistant Examiner*—David Deal
*Attorney, Agent, or Firm*—Haynes and Boone, L.L.P.

[57] ABSTRACT

A wall-mountable liquid dispenser which combines functional and ornamental features in a visually pleasing and space efficient manner. The liquid dispenser includes a main body portion having front, rear, top, bottom and first and second side walls, integrally formed with each other, to define an interior bladder. The main body portion is configured to resemble a comfortably reclined hippopotamus and incudes plural projections which may be depressed to compress the bladder to force the ejection of liquid therefrom. The projections include a first, domed shaped, projection which resembles the stomach of the hippopotamus, a second, generally rectangular, projection which resembles the snout of the hippopotamus and a third, generally rectangular, projection which resembles a mattress on which the hippopotamus is reclined. An aperture is formed in the bottom wall thereof. A fill pipe having a sidewall which defines an interior passageway therein is fixedly attached to the rear wall and covers the aperture such that the fill pipe does not project into the bladder. Mounted to an exterior side surface of the fill pipe is a closeable valve having an interior passageway which may be selectively placed in fluid communication with the interior passageway of the fill pipe to provide a exit path for liquid held in the bladder.

22 Claims, 2 Drawing Sheets

DISPENSER FOR SHAMPOO, LIQUID SOAP OR THE LIKE

BACKGROUND OF THE INVENTION

1. Field of the Invention

The present invention is related to liquid dispensers and, more particularly, to a wall-mountable liquid dispenser which combines functional and ornamental features in a visually pleasing and space-efficient manner.

2. Description of Related Art

Devices which store and dispense liquids have been in use for many years. These devices, commonly referred to as liquid dispensers, have been constructed in a wide variety of shapes and sizes. Broadly speaking, a typical liquid dispenser includes a bladder in which a liquid is held, a nozzle or other type of exit aperture through which the liquid held in the bladder is dispensed and an actuator which forces the liquid out the exit aperture. In many instances, the shape of a liquid dispenser, as well as its bladder, is strictly functional. However, in order to improve the aesthetics thereof, a number of liquid dispensers have incorporated ornamental features therein.

Whether functional or ornamental in design, liquid dispensers may be generally classified as either free-standing, i.e., those that rest on a generally horizontal support surface, or mountable, i.e., those that are mounted onto a generally vertical support surface. Generally, space constraints are rarely of concern when designing free-standing liquid dispensers. Thus, while many free-standing liquid dispensers have predominately functional designs, a wide variety of ornamental free-standing liquid dispensers have also been disclosed in the art. See, for example, U.S. Pat. Nos. 611,653 to Standiford, 1,660,085 to Nassau, 2,739,420 to Dugdale, 3,105,612 to Krasnoff et al. and 3,220,609 to Russell et al.

For mountable liquid dispensers, strictly functional designs are more often the norm. See, for example, U.S. Pat. Nos. 3,078,016 to Judy and 4,793,517 to Washut. While various mountable liquid dispensers which include ornamental features have also been disclosed, see, for example, U.S. Pat. Nos. 2,272,465 to Horstman, 3,388,835 to Naughten, 3,623,638 to Henning and 4,749,104 to Chao, a variety of design constraints limit the incorporation of ornamental features into mountable liquid dispensers. For example, at least one wall portion of the liquid dispenser must have structure capable of mounting the dispenser to a wall or other generally vertical support structure. In addition, the liquid dispenser must be suitably dimensioned in view of the contemplated uses of the support structure. For example, it is often desirable to mount a liquid dispenser containing shampoo, liquid soap or the like to a shower or bathtub wall. If the liquid dispenser projects too far from the wall, however, the dispenser could easily interfere with bathing or other activities.

Finally, if a liquid dispenser incorporates a variety of ornamental features, oftentimes, the requisite functionality thereof severely detract from the appeal of the ornamental features. For example, pumps, valves and other actuators often diminish the attractiveness of a liquid dispenser having an otherwise appealing ornamental shape.

It can be readily seen from the foregoing that it would be desirable to provide a wall-mountable liquid dispenser which combines functional and ornamental features in a visually pleasing and space-efficient manner. Accordingly, it is an object of the present invention to provide such a liquid dispenser.

SUMMARY OF THE INVENTION

The present invention is of a wall-mountable liquid dispenser which combines functional and ornamental features in a visually pleasing and space efficient manner. The liquid dispenser includes a main body portion having front, rear, top, bottom and first and second side walls, integrally formed with each other, to define an interior bladder. The main body portion is configured to resemble a comfortably reclined hippopotamus and incudes plural projections which may be depressed to compress the bladder to force the ejection of liquid therefrom. The projections include a first, domed shaped, projection which resembles the stomach of the hippopotamus, a second, generally rectangular, projection which resembles the snout of the hippopotamus and a third, generally rectangular, projection which resembles a mattress on which the hippopotamus is reclined.

The main body portion of the liquid dispenser also includes an aperture formed in the bottom wall thereof. A fill pipe having a sidewall which defines an interior passageway therein is fixedly attached to the rear wall and covers the aperture such that the fill pipe does not project into the bladder. Mounted to an exterior side surface of the fill pipe is a closeable valve having an interior passageway which may be selectively placed in fluid communication with the interior passageway of the fill pipe to provide a exit path for liquid held in the bladder.

BRIEF DESCRIPTION OF THE DRAWING

The invention will be better understood and its numerous objects and advantages will become apparent to those skilled in the art by reference to the following drawing in which.

DETAILED DESCRIPTION

Figure 1:
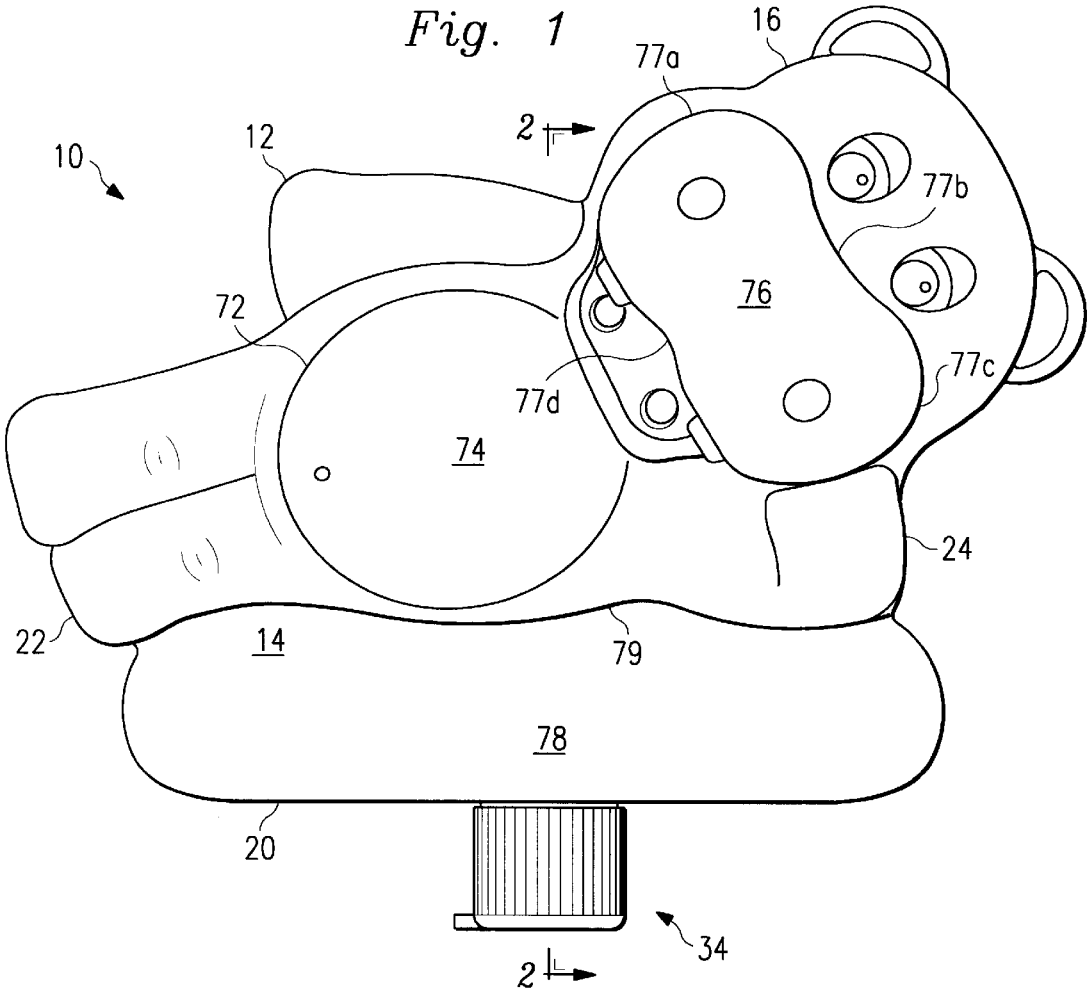
FIG. 1 is a front end view of a liquid dispenser constructed in accordance with the teachings of the present invention and which combines functional and ornamental features in a visually pleasing and space-efficient manner.

Referring now to FIG. 1, a liquid dispenser 10 constructed in accordance with the teachings of the present invention and specially configured to combine functional and ornamental features in a visually pleasing and space-efficient manner will now be described in greater detail. More specifically, the liquid dispenser 10 is configured to resemble a hippopotamus comfortably reclined on a top side surface of an object, for example, a mattress. Of course, the liquid dispenser 10 may be configured to resemble other animated figures, for example, an elephant, in either a similar, or differing, pose.

The liquid dispenser 10 is comprised of a main body portion 12 formed of a soft, deformable plastic material which is extremely tear resistant. Preferably, the plastic material will be selected to have a visually pleasing color, for example, teal. The main body portion 12 includes a front wall 14, a top wall 16, a rear wall 18, a bottom wall 20, a first side wall 22 and a second side wall 24, all of which are integrally formed together to define an interior bladder 26 for holding liquid soap, shampoo and other suitable liquids. Selected ones of the walls 14 through 24, for example, the front wall 14 are shaped to form the ornamental features of the liquid dispenser 10 while others of the walls, for example, the rear wall 18, are generally flat and without any ornamentality. Furthermore, the top wall 16, the bottom wall 20 and the first and second sidewalls 22 and 24 are dimensioned to be noticeably less than the front wall 14, thereby permitting the liquid dispenser 10 to be highly space-efficient by project outwardly only a minimal distance from the vertical support structure. For example, it is contemplated that the liquid dispenser 10 may outwardly project only about 2.625 inches from the vertical support structure while having a front wall 14 having a height of about 5.5 inches and a width of about 7.375 inches. In this manner, it is unlikely that the liquid dispenser 10 would interfere with other uses of the shower or bathtub within which it is mounted.

Figure 3:
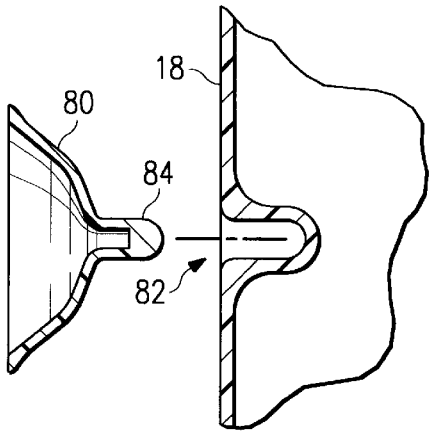
FIG. 3 is an exploded partial cross-sectional view of the liquid dispenser of FIG. 2 taken along lines 3—3 thereof.
Figure 2:
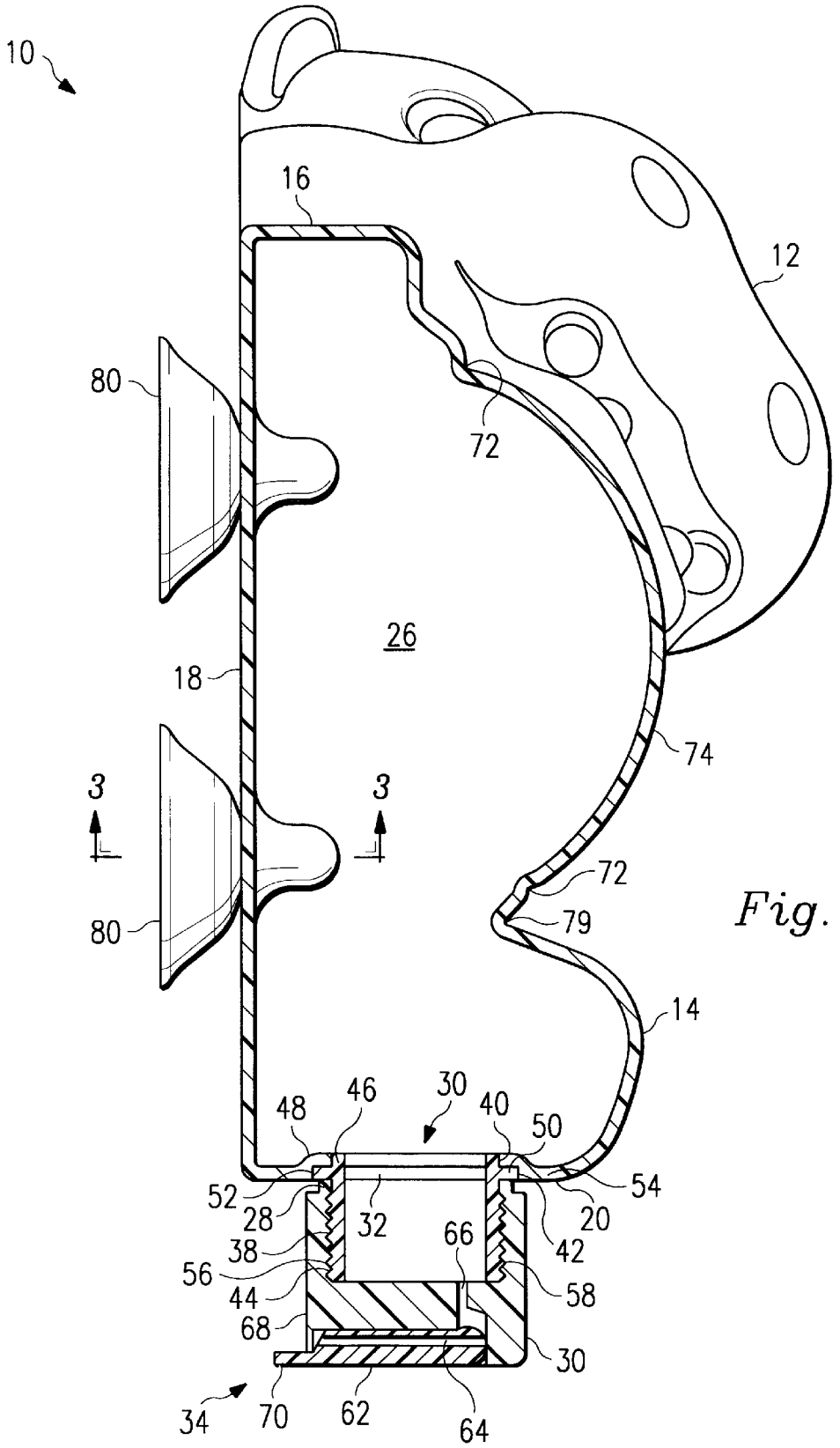
FIG. 2 is a cross-sectional view of the liquid dispenser of FIG. 1 taken along lines 2—2 thereof.

Referring next to FIGS. 2–3, the manner by which the liquid dispenser 10 is mounted to a vertically orientated support structure (not shown), for example, the sidewall of a bathtub, will now be described in greater detail. As may now be seen, plural suction cups 80, each fixedly attached to the rear wall 18 of the liquid dispenser 10 are used to mount the liquid dispenser 10 to the vertically orientated support structure. For example, three suction cups 80, respectively positioned at selected locations spaced along the rear wall 18 of the liquid dispenser 10 has proven suitable to mount the liquid soap dispenser 10, with a liquid-filled bladder 26, to a vertically orientated support structure.

It is contemplated that the suction cups 80 may be fixedly attached to the rear wall 18 in a variety of manners. Preferably, when forming the liquid dispenser 10, the rear wall 18 should be thickened at each of the selected locations. An indentation 82 is then formed at each of the selected locations along the rear wall 18. A shaft portion 84 of the suction cup 80 is insertably mounted in the indentation 82, for example, by solvent bonding the shaft portions 84 of the suction cups 80 to the rear wall 18 of the liquid dispenser 10.

Referring now to FIGS. 1–2, a combination fill/dispense structure 34 included as part of the liquid dispenser 10 will now be described in greater detail. As may now be seen, the combination fill/dispense structure 34 is attached to the bottom wall 22 of the liquid dispenser 10. More specifically, access to the bladder 26 is available through a generally circular aperture 30 which extends from a top side surface 32 of the bottom wall 20 to the bladder 26. A lip 28 extends around the periphery of the generally circular aperture 30. The lip 28 is formed by removing a generally ring-shaped portion of the bottom wall 22 to expose horizontal and vertical interior side surfaces thereof.

The combination fill/dispense structure 34 is comprised of a closeable dispenser valve 36 mounted to a fill pipe 38. The fill pipe 38 is comprised of first, second and third sections 40, 42 and 44 integrally formed with each other. When mounted to the bottom wall 20 of the liquid dispenser 10, a top side surface 46 of the first section 40 lies flush with an interior side surface 48 of the bottom wall 22, a top side surface 50 of the second section 42 engages the lip 28 and an edge side surface 52 of the second section 42 engages an exposed interior surface 54 of the bottom wall 20. Preferably, a layer of adhesive material (not shown) is used to secure the fill pipe 38 to the bottom wall 22 of the liquid dispenser 10.

When the fill pipe 38 is secured to the bottom wall 20 of the liquid dispenser 10, the third section 44 thereof downwardly projects from a bottom side surface of the bottom wall 20. The closeable valve 36 is screw-mounted to the third section 44 of the fill pipe 38 by the engagement of complementary threads 56, 58, respectively formed on the outer side surface of the third section 44 of the fill pipe 38 and the inner side surface of the closeable valve 36.

The closeable valve 36 includes a first interior passageway 66 formed in a main body portion 68 thereof to be in fluid communication with the bladder 26 via the aperture 30 in the fill pipe 38 and a second interior passageway 64 formed in a pivotable member 62. When the closeable valve 36 is in the closed position illustrated in FIGS. 1–2, the first and second interior passageways 66 and 64 are not in fluid communication with each other and no liquid can exit the bladder 26. When the closeable valve 36 is pivoted into the open position, for example, by gasping a tip portion 70 and pivoting the member 62 into an upright position, the first and second interior passageways 66 and 64 are in fluid communication with each other, thereby providing a path along which liquids such as shampoo or soap can be dispensed from the bladder 26.

As previously stated, when the closeable valve is in the closed position, liquids cannot be dispensed from the bladder 26. To dispense a liquid therefrom, the pivotable member 62 is moved into the open position where the first and second interior passageways 66 and 64 are in fluid communication with each other. As the fill/dispense structure 34 dispenser is located below the bladder 26, the force of gravity encourages liquids held therein to flow from the bladder 26 and through the aperture 30, the first interior passageway 66 and the second interior passageway 64. However, as the first and second interior passageways 66 and 64 are relatively narrow, it is contemplated that low viscosity liquids will be capable of flowing out of the bladder 26 under the influence of gravity and without further assistance while high viscosity liquids will remain in the bladder 26.

To dispense high viscosity liquids which otherwise cannot flow out of the bladder 26, a compressive force must be exerted on the bladder 26. The requisite compressive force is generated by reducing the volume of the bladder, for example, using a squeezing movement. As one may readily appreciate upon examining the liquid dispenser 10 subject of the present application, the various ornamental features incorporated into the walls 14 through 24, particularly, the front wall 14, which define the bladder 26 results in a varied topography which resultantly includes plural sidewalls, i.e., walls that extend away from the vertical support structure. Generally, the aforementioned sidewalls make it more difficult to compress the bladder 26. This is of particular concern for liquid dispensers such as the one disclosed herein, which is designed for use by young children.

To improve the compressibility characteristics of the liquid dispenser 10, the front wall 14 is provided with a generally circular indentation 72 which defines a first, dome-shaped, projection 74 in the front wall 14. The absence of sidewalls in the vicinity of the first, dome-shaped, projection 74 makes it easier to successfully compress the bladder 26 by exerting pressure on the first, dome-shaped, projection 74.

As may be best seen in FIG. 2, the first, dome-shaped, projection 74 is shaped to resemble a stomach portion of the hippopotamus. By specially incorporating the first, dome-shaped, projection 74 as a centrally located, visually appealing, portion of the front wall 14, young children tend to intuitively know that to depress the first, dome-shaped, projection 74 will force high viscosity fluids from the bladder 26. To further make the first, dome-shaped, projection 74 visually distinctive such that the depression thereof by young children is encouraged, the first, dome-shaped, projection 74 may be colored to sharply contrast with other portions of the liquid dispenser 10. For example, the front wall 14 of the liquid dispenser 10 may be the aforementioned teal color while the first, dome-shaped, projection 74 may be painted in a pure white color.

The front wall 14 is also provided with a second, generally rectangular, projection distinctively shaped to encourage the depression thereof by young children. More specifically, the front wall 14 further includes a second, generally rectangular, projection 76 defined by sidewalls 77*a,* 77*b,* 77*c* and 77*d.* In this manner, the second, generally rectangular, projection 76 appears raised relative to the remainder of the front wall 14. While, in the embodiment of the invention disclosed herein, the second, generally rectangular, projection 76 lacks the contrasting color and unique dome-shape that makes the first, dome-like, projection 74 appealing to young children, the second, generally rectangular, projection 76 also has distinctive visual appeal in that it appears raised relative to the remainder of the front wall 14, including the first, dome-like, projection 74 and is also shaped like a snout portion of the hippopotamus. As before, young children will tend to intuitively depress the generally rectangular projection 76 to force high viscosity fluids from the bladder 26.

The front wall 14 of the liquid dispenser 10 is further provided with a third, generally rectangular, projection distinctively shaped to encourage the depression thereof by young children. More specifically, the front wall 14 further includes an indentation 79 which extends from the first sidewall 22 to the second sidewall 24. The third, generally rectangular, projection 78 extends from the indentation 79 to the bottom wall 20. In this manner, the third, generally rectangular, projection 78 appears raised relative to the remainder of the front wall 14. As the third, generally rectangular, projection 78 is laterally extensive, i.e., extends between the first side wall 22 and the second side wall 24 and is colored to sharply contrast with the remainder of the liquid dispenser 10, for example, by painting the third, generally rectangular, projection 78 in a cream color, the third, generally rectangular, projection 78 is visually appealing in a manner which attracts depression thereof by young children.

When all of the shampoo or other liquid held in the bladder 26 of the liquid dispenser 10 has been dispensed, the bladder 26 is refilled in the following manner. The liquid dispenser 10 is first detached from the vertical support structure, for example, by pulling on the main body portion 12 until the suction cups 80 disengage from the vertical support structure. The liquid dispenser 10 is then inverted so that the combination fill/dispense structure 34 faces upward. The closeable valve 36 is then unscrewed from the fill pipe 38 and additional liquid poured into the bladder 26 through the aperture 30 in the fill pipe 38. After the bladder 26 has been filled with the additional liquid, the closeable valve 36 is resecured onto the fill pipe 38. If the closeable valve 36 is in the closed position, the liquid dispenser 10 may then returned to its normal orientation and reattached to the vertical support structure.

Thus, there has been described and illustrated herein, a wall-mountable liquid dispenser which combines functional and ornamental features in a visually pleasing and space-efficient manner. However, those skilled in the art will recognize that numerous modifications and variations from that specifically disclosed herein are possible without substantially departing from the scope of the present invention. It should be clearly understood, therefore, that the embodiment of the invention disclosed herein is considered to be exemplary only and should not be construed as limiting the invention, which is defined only by the claims appended hereto.

What is claimed is:

1. A liquid dispenser, comprising:

a main body portion, said main body portion having front, rear, top, bottom and first and second side walls which collectively define an interior bladder;

said bottom wall of said main body portion having interior and exterior side surfaces and an aperture extending therebetween;

said main body portion having a lip formed by exposing inner side and edge surfaces of a portion of said bottom wall, said lip circumferentially surrounding said aperture;

a fill pipe fixedly attached to said bottom wall and downwardly projecting therefrom, said fill pipe having a sidewall, an interior surface of which defines an interior passageway in fluid communication with said aperture;

said fill pipe being comprised of first, second and third sections, said second section of said fill pipe engaging said lip of said bottom wall and said third section projecting downwardly from said exterior side surface of said bottom wall when said first section of said fill pipe is inserted in said aperture to engage an interior wall which defines said aperture;

said second section of said fill pipe further comprising a top side surface which engages said exposed inner side surface of said bottom wall and an edge side surface which engages said exposed inner edge surface of said bottom wall when said second section of said fill pipe engages said lip of said bottom wall; and a closeable valve removably mounted to an exterior surface of said sidewall of said full pipe, said closeable valve having an interior passageway which may be selectively placed in fluid communication with said interior passageway of said fill pipe to provide a exit path for liquid held in said bladder;

wherein access to said fill pipe for filling said interior bladder with liquid is provided by removing said closeable valve and inverting said main body portion.

2. A liquid dispenser according to claim 1 wherein said exterior side surface of said sidewall of said fill pipe and an interior side surface of said closeable valve further comprise complementarily threaded portions which engage each other to removably mount said closeable valve to said fill pipe.

3. A liquid dispenser according to claim 1 wherein a top side surface of said first section of said fill pipe lies flush with said interior side surface of said bottom wall when said first section of said fill pipe is inserted in said aperture.

4. A liquid dispenser according to claim 3 wherein said second section of said fill pipe further comprises a bottom side surface which lays flush with said exterior side surface of said bottom wall when said second section of said fill pipe engages said lip of said bottom wall.

5. A liquid dispenser according to claim 4 wherein a first, dome-shaped, projection is formed in said front wall.

6. A liquid dispenser according to claim 5 wherein said first, dome-shaped, projection and the remainder of the front wall are contrastly colored, thereby rendering the first, dome-shaped projection visually distinctive to encourage intuitive depression thereof by young children.

7. A liquid dispenser for shampoo, liquid soap and the like, comprising:

a main body portion having front, rear, top, bottom and first and second side walls which collectively define an interior bladder;

said bottom wall of said main body portion having interior and exterior side surfaces and an aperture extending therebetween; and a fill/dispense structure mounted to said bottom wall of said main body portion, said fill/dispense structure providing access, through said aperture, to said interior bladder to fill said dispenser with liquid/dispense liquid from said interior bladder;

said front wall of said main body portion formed to include a first, generally dome-shaped, projection and a second, generally rectangular-shaped, projection, the depression of either of which compresses said interior bladder to force liquid to exit said interior bladder through said fill/dispense structure;

said front wall of said main body portion further formed to include a first, generally circular, indentation which defines said first, dome-shaped, projection and a second indentation, said second indentation extending from said first side wall to said second side wall, said second projection extending from said second indentation to said bottom wall.

8. A liquid dispenser according to claim 7 wherein said first, dome-shaped, projection is colored to contrast with the remainder of said front wall, thereby rendering the first, dome-shaped projection visually distinctive to encourage intuitive depression thereof by young children.

9. A liquid dispenser according to claim 7 wherein said front wall of said main body portion is formed to include a third projection, the depression of which also compresses said interior bladder to force liquid to exit said interior bladder through said fill/dispense structure.

10. A liquid dispenser according to claim 7 wherein said first and second projections are colored to contrast with the remainder of said front wall, thereby rendering the first and second projections visually distinctive to encourage intuitive depression thereof by young children.

11. A liquid dispenser according to claim 10 wherein said main body portion is shaped to resemble an animal, said first projection is shaped to resemble a stomach of said animal, said second projection is shaped to resemble a mattress on which said animal is reclined and said third projection is shaped to resemble a portion of a head of said animal.

12. A liquid dispenser according to claim 7 wherein said fill/dispense structure further comprises:

a fill pipe fixedly attached to said bottom wall of said main body portion and projecting downwardly therefrom, said fill pipe having a sidewall, an interior surface of which defines an interior passageway in fluid communication with said aperture; and a closeable valve removably mounted to an exterior surface of said sidewall of said fill pipe, said closeable valve having an interior passageway which may be selectively placed in fluid communication with said interior passageway of said fill pipe to provide an exit path for liquid held in said bladder.

13. A liquid dispenser according to claim 12 wherein said main body portion further comprises a lip formed by exposing inner side and edge surfaces of a portion of said bottom wall, said lip circumferentially surrounding said aperture.

14. A liquid dispenser according to claim 13 wherein said fill pipe is comprised of first, second and third sections, a top side surface of said first section of said fill pipe laying flush with said interior side surface of said bottom wall, said second section of said fill pipe engaging said lip of said bottom wall and said third section projecting downwardly from said exterior side surface of said bottom wall when said first section of said fill pipe is inserted in said aperture.

15. A liquid dispenser according to claim 14 wherein said second section of said fill pipe further comprises a top side surface which engages said exposed inner side surface of said bottom wall, an edge side surface which engages said exposed inner edge surface of said bottom wall and a bottom side surface which lays flush with said exterior side surface of said bottom wall when said second section of said fill pipe engages said lip of said bottom wall.

16. A liquid dispenser according to claim 15 wherein said exterior side surface of said sidewall of said fill pipe and an interior side surface of said closeable valve further comprise complementarily threaded portions which engage each other to rotatably mount said closeable valve to said fill pipe.

17. A liquid dispenser for shampoo, liquid soap and the like, comprising:

a main body portion having front, rear, top, bottom and first and second side walls which collectively define an interior bladder;

said bottom wall of said main body portion having interior and exterior side surfaces and an aperture extending therebetween; and a fill/dispense structure mounted to said bottom wall of said main body portion, said fill/dispense structure providing access, through said aperture, to said interior bladder to fill said dispenser with liquid/dispense liquid from said interior bladder;

said front wall of said main body portion formed to include an indentation and a projection, said projection at least partially defined by said indentation;

wherein the depression of said projection compresses said interior bladder to force liquid to exit said interior bladder through said fill/dispense structure and wherein said indentation, by extending between said projection and at least one of said top, bottom, first side and second side walls, enhances compressibility of said interior bladder in response to the depression of said projection.

18. A liquid dispenser according to claim 17 wherein said projection is generally dome-shaped.

19. A liquid dispenser according to claim 18 wherein said indentation is located between said projection and said bottom wall and extends from said first side wall to said second side wall.

20. A liquid dispenser according to claim 18 wherein said indentation is a generally circular indentation which defines said first, dome-shaped projection.

21. A liquid dispenser according to claim 17 wherein said projection is generally rectangular.

22. A liquid dispenser according to claim 21 wherein said indentation is located between said projection and said bottom wall and extends from said first side wall and said second side wall and wherein said projection extends from said indentation to said bottom wall.

* * * * *